US009196204B2

(12) United States Patent
Higashi et al.

(10) Patent No.: US 9,196,204 B2
(45) Date of Patent: Nov. 24, 2015

(54) IMAGE PROCESSING APPARATUS AND IMAGE PROCESSING METHOD

(71) Applicant: Japan Display Inc., Tokyo (JP)

(72) Inventors: Amane Higashi, Aichi (JP); Toshiyuki Nagatsuma, Kanagawa (JP); Akira Sakaigawa, Kanagawa (JP); Masaaki Kabe, Kanagawa (JP)

(73) Assignee: Japan Display Inc., Tokyo (JP)

( * ) Notice: Subject to any disclaimer, the term of this patent is extended or adjusted under 35 U.S.C. 154(b) by 343 days.

(21) Appl. No.: 13/744,120

(22) Filed: Jan. 17, 2013

(65) Prior Publication Data

US 2013/0241810 A1 Sep. 19, 2013

(30) Foreign Application Priority Data

Mar. 19, 2012 (JP) ..... 2012-061370

(51) Int. Cl.

| | |
|---|---|
| ***G09G 5/10*** | (2006.01) |
| ***G09G 3/36*** | (2006.01) |
| ***G09G 3/34*** | (2006.01) |
| *G09G 5/02* | (2006.01) |

(52) U.S. Cl.

CPC ..... *G09G 3/3611* (2013.01); *G09G 3/3406* (2013.01); *G09G 3/3607* (2013.01); *G09G 5/02* (2013.01); *G09G 2320/0233* (2013.01); *G09G 2320/0276* (2013.01); *G09G 2340/06* (2013.01)

(58) Field of Classification Search

CPC ... G09G 5/02; G09G 3/3607; G09G 2340/06; G09G 2320/0233

USPC ..... 345/690

See application file for complete search history.

(56) References Cited

U.S. PATENT DOCUMENTS

| | | | | |
|---|---|---|---|---|
| 5,926,617 | A * | 7/1999 | Ohara et al. | 358/1.9 |
| 2005/0140614 | A1 * | 6/2005 | Baek | 345/87 |
| 2010/0091030 | A1 * | 4/2010 | Park et al. | 345/589 |
| 2012/0299982 | A1 | 11/2012 | Inada | |

FOREIGN PATENT DOCUMENTS

| | | |
|---|---|---|
| JP | 2005-309436 | 11/2005 |
| JP | 2010-033009 | 2/2010 |
| JP | 2012-053256 | 3/2012 |
| WO | 2011/102321 | 8/2011 |

OTHER PUBLICATIONS

Notice of Rejection issued in connection with Japanese Patent Application No. 2012-061370, dated Mar. 3, 2015. (4 pages).

* cited by examiner

*Primary Examiner* — Chanh Nguyen
*Assistant Examiner* — Yuzhen Shen
(74) *Attorney, Agent, or Firm* — K&L Gates LLP

(57) ABSTRACT

An image processing apparatus includes an image display unit and a luminance control unit. The image display unit includes pixels arranged in a matrix, each of which is formed of a first sub-pixel, a second sub-pixel, a third sub-pixel, and a fourth sub-pixel, and performs image display. The luminance control unit adjusts a ratio between a generation amount of first luminance generated by the first sub-pixel, the second sub-pixel, and the third sub-pixel and a generation amount of second luminance generated by the fourth sub-pixel. Over all input tones, the luminance control unit makes the generation amount of the second luminance lower than the generation amount of the first luminance and generates the second luminance so that a function representing a luminance value of the second luminance is continuous.

6 Claims, 9 Drawing Sheets

IMAGE PROCESSING APPARATUS AND IMAGE PROCESSING METHOD

CROSS REFERENCES TO RELATED APPLICATIONS

The present application claims priority to Japanese Priority Patent Application JP 2012-061370 filed in the Japan Patent Office on Mar. 19, 2012, the entire content of which is hereby incorporated by reference.

BACKGROUND

The present application relates to an image processing apparatus and an image processing method that perform image processing.

In recent years, high-definition liquid crystal panels capable of being used for a digital camera or the like have been developed. In the high-definition liquid crystal panels, an RGBW format is employed in which a sub-pixel of white (W) is added to sub-pixels of red (R), green (G), and blue (B) so as to constitute one pixel.

Addition of a white sub-pixel makes white color brighter and thereby allows the same brightness as an existing RGB liquid crystal panel to be maintained, even if the power consumption of a backlight is reduced by, for example, 50%. Luminance can also be improved to about twice that of the existing liquid crystal panel, thereby suppressing the power consumption of the backlight and improving visibility outdoors.

In this way, in the RGBW high-definition liquid crystal panel, white color can be generated by using a W sub-pixel. However, if white luminance of the W sub-pixel is high, the outline of the arrangement of the W sub-pixel may be visually recognized on a screen. Thus, a technique in which image quality is improved by suppressing white luminance of a W sub-pixel and increasing white luminance generated by RGB sub-pixels has been proposed (Japanese Unexamined Patent Application Publication No. 2010-33009).

SUMMARY

In Japanese Unexamined Patent Application Publication No. 2010-33009 (hereinafter referred to as related art), a generation amount of white luminance generated by a W sub-pixel is suppressed and a generation amount of white luminance generated by RGB sub-pixels is increased. However, there is a difference in chromaticity between white color generated by the W sub-pixel and white color generated by the RGB sub-pixels.

For this reason, in image display in the related art, when white color generated by the W sub-pixel begins to emerge, a color change between a white color portion generated by the RGB sub-pixels on a screen and a white color portion generated by the W sub-pixel on the screen is likely to be visually recognized, thereby causing degradation of image quality.

For example, when a gradation image with 256 tones in a gray scale of 0 to 255 is displayed, in the related art, white color is generated by RGB sub-pixels in gray portions at low tones, and W sub-pixels are also used from a certain level of high tone.

In this case, in a portion at a tone at which white color begins to be generated by the W sub-pixels, the boundary of a color change between the white color generated by the RGB sub-pixels and the white color generated by the W sub-pixels may be visually recognized on the screen.

In the present application, it is desirable to provide an image processing apparatus and an image processing method in which degradation of image quality due to a change in chromaticity is improved.

According to an embodiment of the present application, there is provided an image processing apparatus. The image processing apparatus includes an image display unit and a luminance control unit. The image display unit includes pixels arranged in a matrix, each of which is formed of a first sub-pixel, a second sub-pixel, a third sub-pixel, and a fourth sub-pixel, and performs image display. The luminance control unit adjusts a ratio between a generation amount of first luminance generated by the first sub-pixel, the second sub-pixel, and the third sub-pixel and a generation amount of second luminance generated by the fourth sub-pixel.

Over all input tones, the luminance control unit makes the generation amount of the second luminance lower than the generation amount of the first luminance and generates the second luminance so that a function representing a luminance value of the second luminance is continuous.

Degradation of image quality due to a change in chromaticity may be improved.

Additional features and advantages are described herein, and will be apparent from the following Detailed Description and the figures.

DETAILED DESCRIPTION

Figure 1:
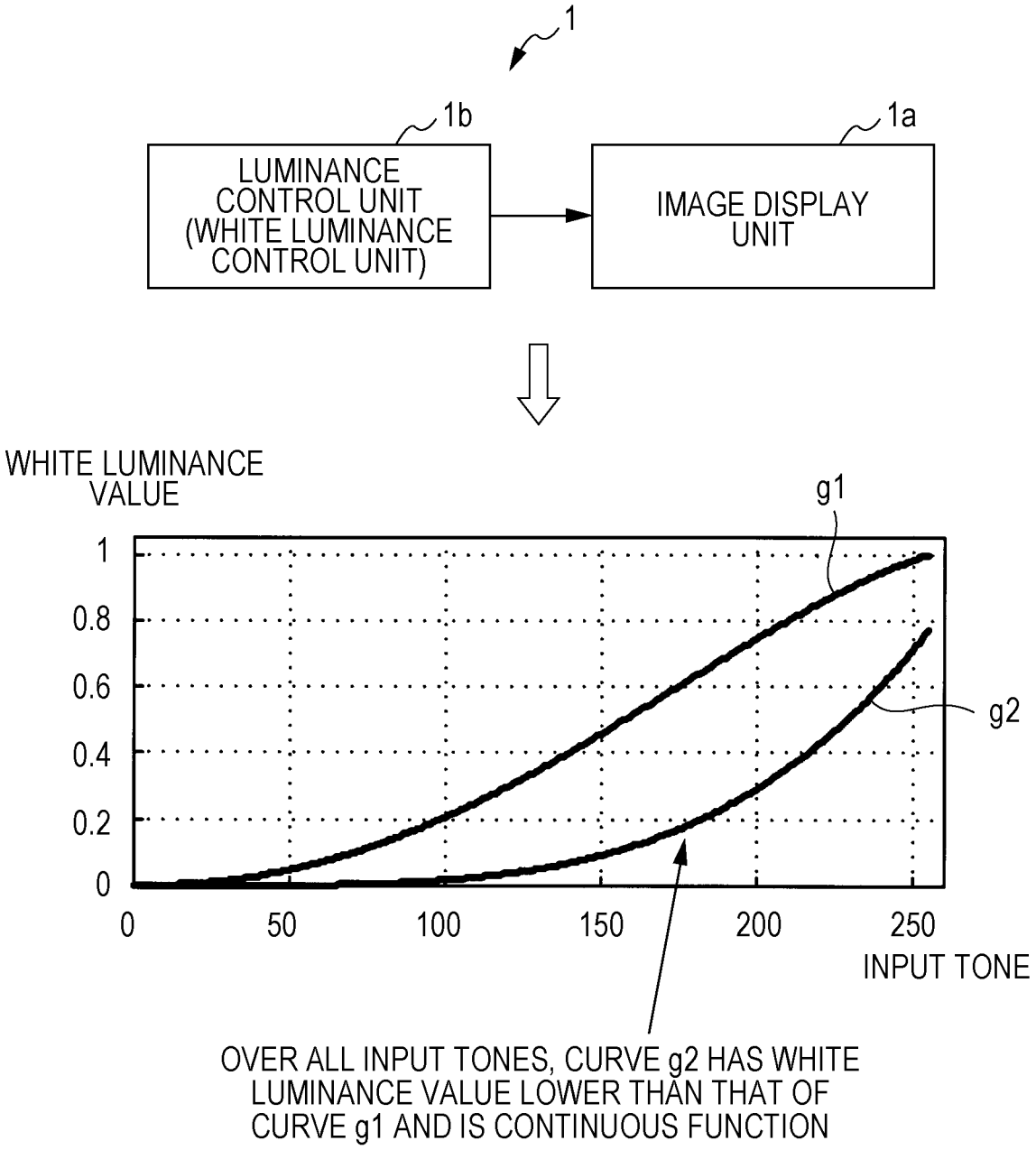
FIG. 1 illustrates an example of the structure of an image processing apparatus.

An embodiment will be described below with reference to the accompanying drawings. FIG. 1 illustrates an example of the structure of an image processing apparatus. An image processing apparatus 1 includes an image display unit 1*a* and a luminance control unit 1*b*.

The image display unit 1*a* includes pixels arranged in a matrix, each of which is formed of a first sub-pixel, a second sub-pixel, a third sub-pixel, and a fourth sub-pixel, and performs image display. The luminance control unit 1*b* adjusts a ratio between a generation amount of first luminance generated by the first sub-pixel, the second sub-pixel, and the third sub-pixel and a generation amount of second luminance generated by the fourth sub-pixel.

Also, over all input tones, the luminance control unit 1*b* makes the generation amount of the second luminance lower than the generation amount of the first luminance and generates the second luminance so that a function representing a luminance value of the second luminance is continuous.

The first sub-pixel, the second sub-pixel, the third sub-pixel, and the fourth sub-pixel will be specifically described below as a red sub-pixel, a green sub-pixel, a blue sub-pixel, and a white sub-pixel, respectively. Hereinafter, the luminance control unit 1*b* is referred to as a white luminance control unit 1*b*.

The image display unit 1*a* corresponds to, for example, a liquid crystal panel, includes a plurality of pixels each formed of a red sub-pixel (R sub-pixel), a green sub-pixel (G sub-pixel), a blue sub-pixel (B sub-pixel), and a white sub-pixel (W sub-pixel), and performs image display with the plurality of pixels arranged in a matrix.

For each pixel, the white luminance control unit 1*b* adjusts a ratio between a generation amount of first white luminance generated by the RGB sub-pixels and a generation amount of second white luminance generated by the W sub-pixel.

In this case, the white luminance control unit 1*b* makes the generation amount of the second white luminance lower than the generation amount of the first white luminance over all input tones. Also, the white luminance control unit 1*b* generates the second white luminance so that a function representing a luminance value of the second white luminance is continuous over all the input tones.

Here, in a graph illustrated in FIG. 1, the vertical axis represents a white luminance value and the horizontal axis represents an input tone. A curve g1 represents a variation of a white luminance value generated by RGB sub-pixels at each of input tones and a curve g2 represents a variation of a white luminance value generated by a W sub-pixel at each of the input tones.

The white luminance value of the curve g2 is suppressed below the white luminance value of the curve g1 over all the input tones. A function of the curve g2 is a continuous function over all the input tones. That is, the curve g2 has no discontinuous points at any of the input tones and represents a smooth change in white luminance.

For each pixel, the white luminance control unit 1*b* adjusts the generation amount of the white luminance generated by the W sub-pixel so as to achieve the white luminance value as indicated by the curve g2. This allows degradation of image quality due to a change in white luminance to be improved.

Figure 2:
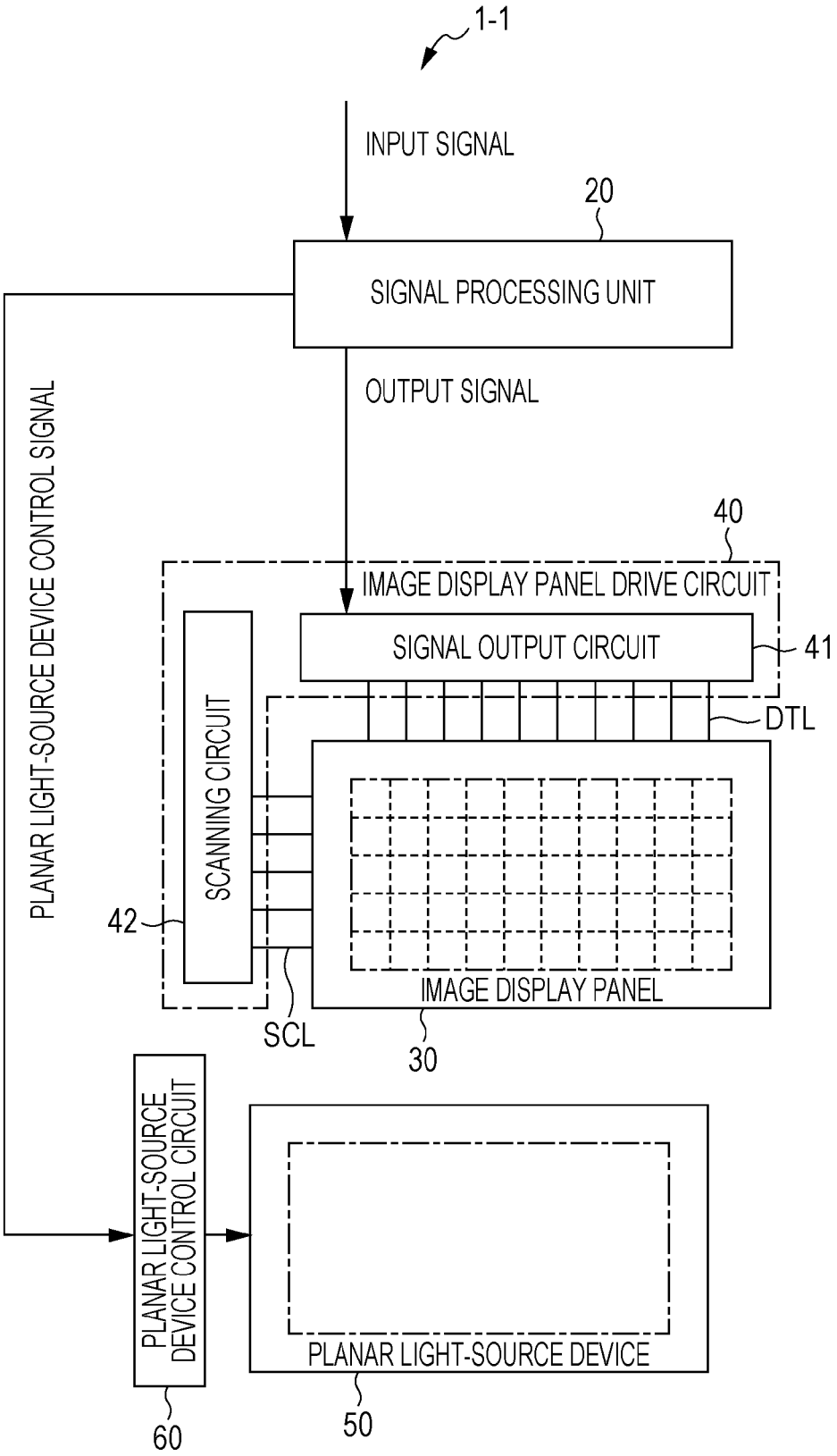
FIG. 2 illustrates an example of the structure of an image processing apparatus.

The specific structure of the image processing apparatus 1 will be described. FIG. 2 illustrates an example of the structure of an image processing apparatus. An image processing apparatus 1-1 includes a signal processing unit 20, an image display panel 30, an image display panel drive circuit 40, a planar light-source device 50, and a planar light-source device control circuit 60.

The image display panel drive circuit 40 includes a signal output circuit 41 and a scanning circuit 42. The signal processing unit 20 includes the function of the white luminance control unit 1*b* in FIG. 1. The image display panel 30 and the image display panel drive circuit 40 include the function of the image display unit 1*a* in FIG. 1.

The signal processing unit 20 performs image processing on input signals and outputs the signals subjected to the image processing to the image display panel drive circuit 40. The signal output circuit 41 is electrically connected to the image display panel 30 via data transmission lines (DTLs) and sequentially outputs the image signals output from the signal processing unit 20 to the image display panel 30.

The scanning circuit 42 is electrically connected to the image display panel 30 via serial clock lines (SCLs) and performs on-off control of switching elements (e.g., thin film transistors (TFTs)) for controlling operations (light transmittance) of sub-pixels in the image display panel 30.

The planar light-source device control circuit 60 performs drive control of the planar light-source device 50 on the basis of a planar light-source device control signal output from the signal processing unit 20. The planar light-source device 50 is a light source (backlight source) that illuminates the image display panel 30 from the back surface thereof.

Figure 3:
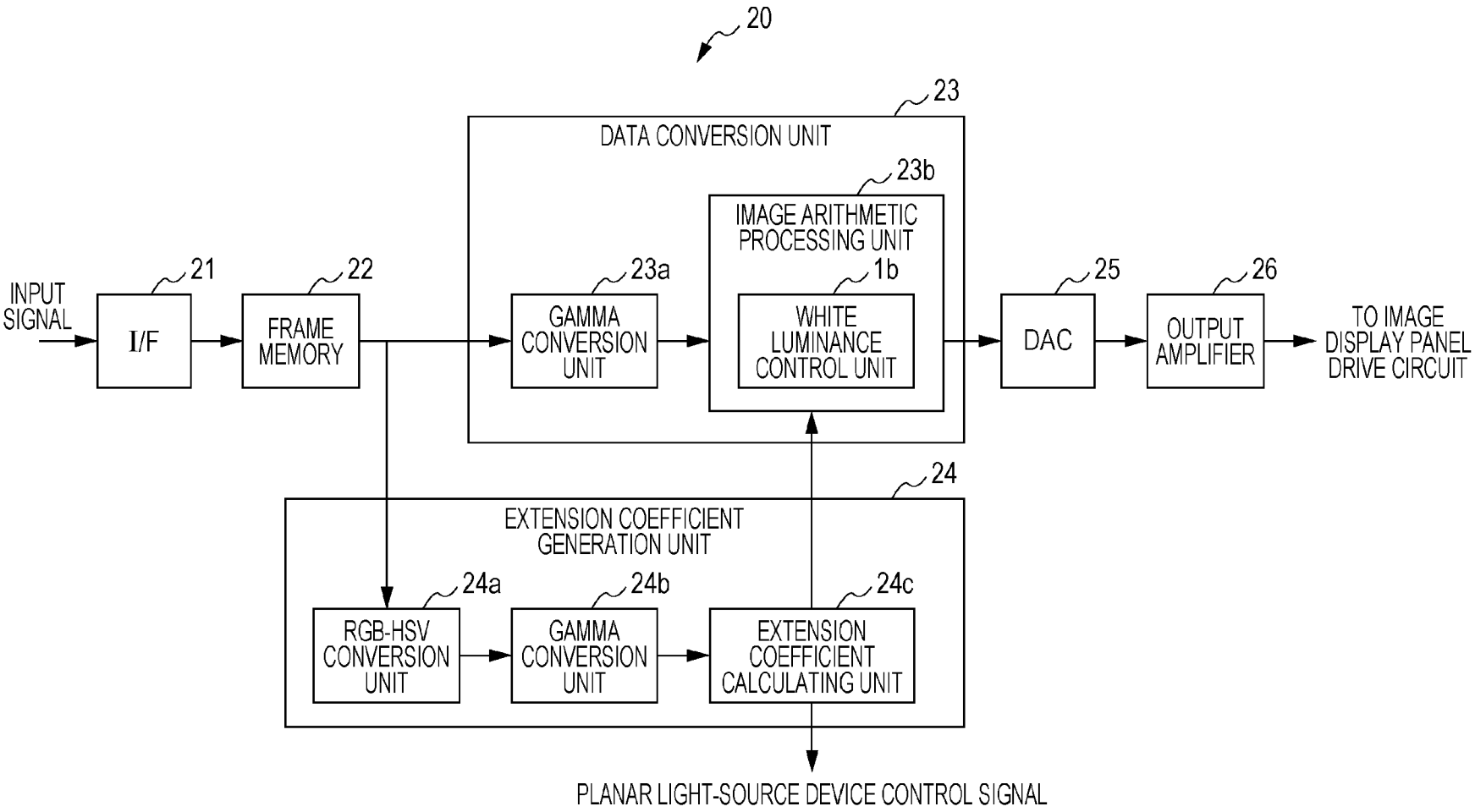
FIG. 3 illustrates an example of the structure of a signal processing unit.

The structure of the signal processing unit 20 will be described. FIG. 3 illustrates an example of the structure of a signal processing unit. The signal processing unit 20 includes an image input interface (I/F) unit 21, a frame memory 22, a data conversion unit 23, an extension coefficient generation unit 24, a digital-to-analog (D/A) converter 25, and an output amplifier 26.

The image input I/F unit 21 receives image signals and performs input interface processing on them. The frame memory 22 stores the input image signals in units of frames. RGB signals, which are the input image signals read out from the frame memory 22, are transmitted to the data conversion unit 23 and the extension coefficient generation unit 24.

The data conversion unit 23 includes a gamma conversion unit 23*a* and an image arithmetic processing unit 23*b*. The gamma conversion unit 23*a* converts luminance components of the input image signals into luminance values (coloring properties) that a liquid crystal panel of a display has.

Figure 4:
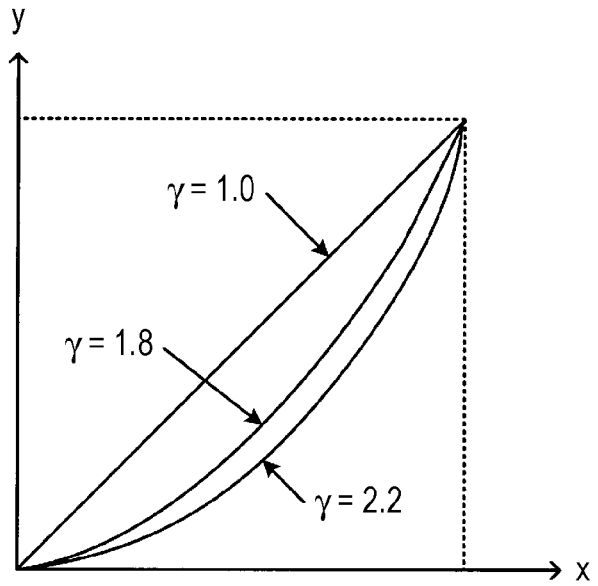
FIG. 4 illustrates gamma characteristics.

FIG. 4 illustrates gamma characteristics. The horizontal axis represents a luminance value within an input image and the vertical axis represents a luminance value within an output image. The relationship of y=x in which a gamma value is "1.0" is ideal. However, the relationship of y=x is not achieved because a display has a specific gamma characteristic (gamma value). For example, in a Windows (registered trademark) standard, a gamma value is adjusted to "2.2".

In gamma characteristics of displays, halftones usually tend to be dark. For this reason, a signal in which the halftones have been made brighter in advance is input so as to approximate a balance of "input:output" to "1:1", thereby precisely reproducing color information. Such a mechanism that adjusts color information in accordance with gamma characteristics of displays is called gamma conversion (gamma correction).

As illustrated in FIG. 3, the image arithmetic processing unit 23*b* receives an extension coefficient transmitted from the extension coefficient generation unit 24, performs image arithmetic processing, and outputs the image signals subjected to the image arithmetic processing. The image arithmetic processing unit 23*b* includes the white luminance control unit 1*b* in FIG. 1.

The D/A converter 25 converts the digital image signals output from the image arithmetic processing unit 23*b* into analog image signals. The output amplifier 26 amplifies levels of the analog image signals and outputs them to the subsequent image display panel drive circuit 40.

The extension coefficient generation unit 24 includes an RGB-HSV conversion unit 24*a*, a gamma conversion unit 24*b*, and an extension coefficient calculating unit 24*c*. The RGB-HSV conversion unit 24*a* converts the RGB signals of the input image into image signals in an HSV space.

H represents hue, S represents saturation or chroma, and V represents brightness, lightness, or value. The HSV space is a color space composed of these three components.

The gamma conversion unit 24*b* performs gamma conversion on the image signals in the HSV space. The extension coefficient calculating unit 24*c* calculates an extension coefficient from the image signals in the HSV space which was subjected to the gamma correction. The extension coefficient calculated by the extension coefficient calculating unit 24*c* is transmitted to the image arithmetic processing unit 23*b*. The extension coefficient is also superimposed on a control signal of the planar light-source device 50 to be output.

The extension coefficient is a parameter that represents what multiple of luminance is capable of being output with respect to the luminance of an original image signal. As an example of color information of one pixel, information on three primary colors of R, G, and B, or information on R, G, B, and W, which is added, is given. When luminance (brightness) of the one pixel is also represented, an extension coefficient $\alpha$ is further added so as to represent the one pixel in combination with the information.

The extension coefficient is also a parameter used to perform control in accordance with an excess or a deficiency of an amount of light emission so that an image signal level is raised (amplitude extension) in the case of a deficiency or an image signal level is reduced (amplitude reduction) in the case of an excess.

Figure 5:
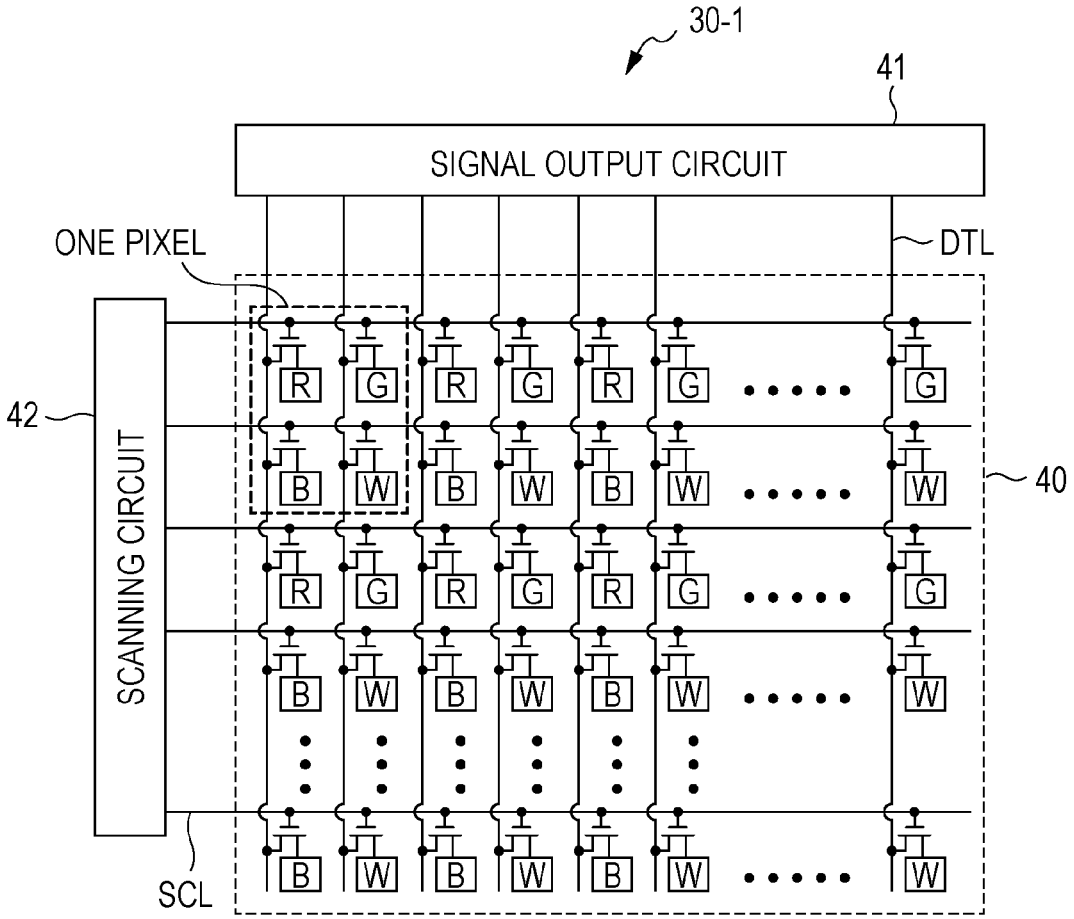
FIG. 5 illustrates an example of the structure of an image display panel.
Figure 6:
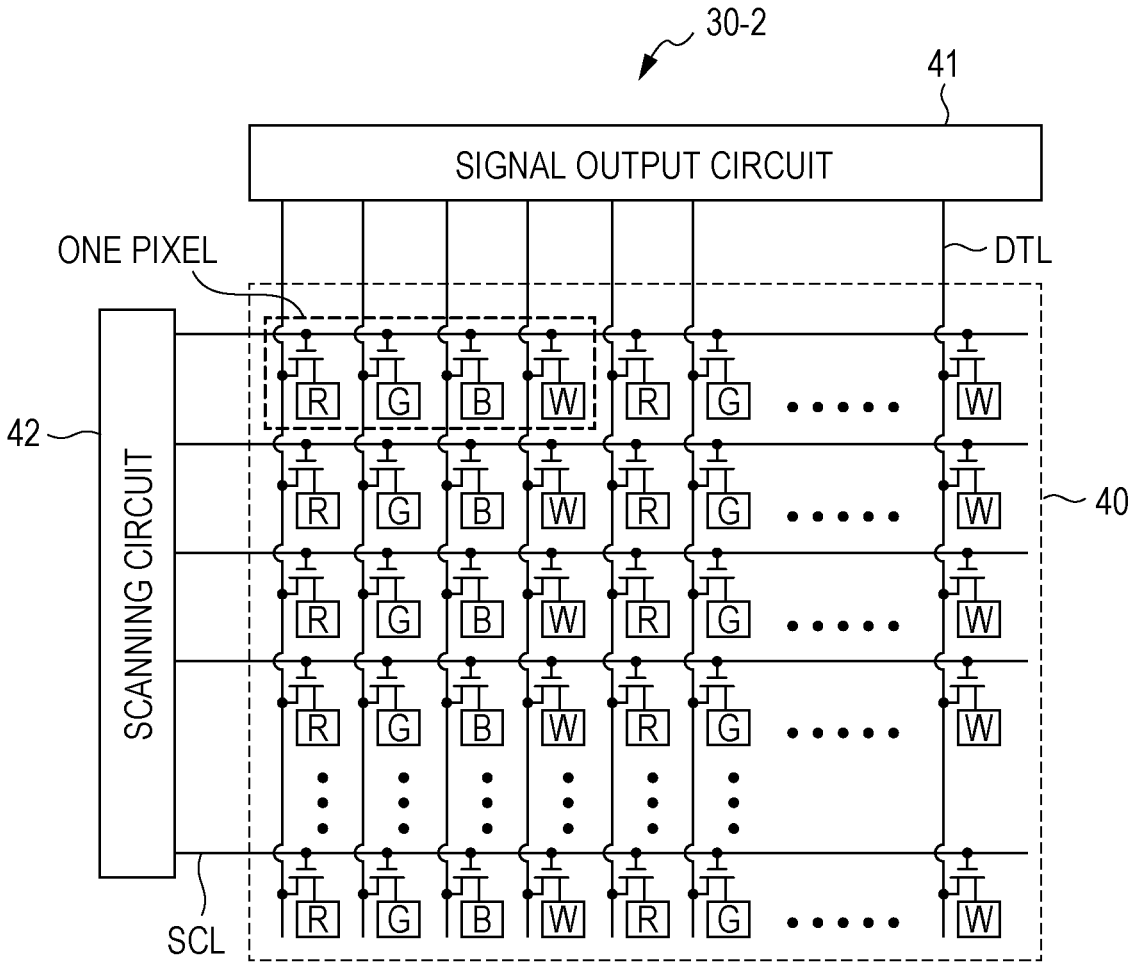
FIG. 6 illustrates an example of the structure of an image display panel.

Examples of the structure of the image display panel 30 will be described. FIGS. 5 and 6 illustrate examples of structures of image display panels. An image display panel 30-1 illustrated in FIG. 5 has P×Q pixels, there being P number of pixels in a horizontal direction and Q number of pixels in a vertical direction. The pixels are arranged in a two-dimensional matrix.

Each pixel includes R, G, B, and W sub-pixels. In the image display panel 30-1, the R, G, B, and W sub-pixels are arranged diagonally (mosaic arrangement) so as to constitute one pixel.

An image display panel 30-2 illustrated in FIG. 6 has P×Q pixels, there being P number of pixels in a horizontal direction and Q number of pixels in a vertical direction. The pixels are arranged in a two-dimensional matrix.

Each pixel includes R, G, B, and W sub-pixels. In the image display panel 30-2, the R, G, B, and W sub-pixels are arranged in a stripe pattern so as to constitute one pixel.

Figure 7:
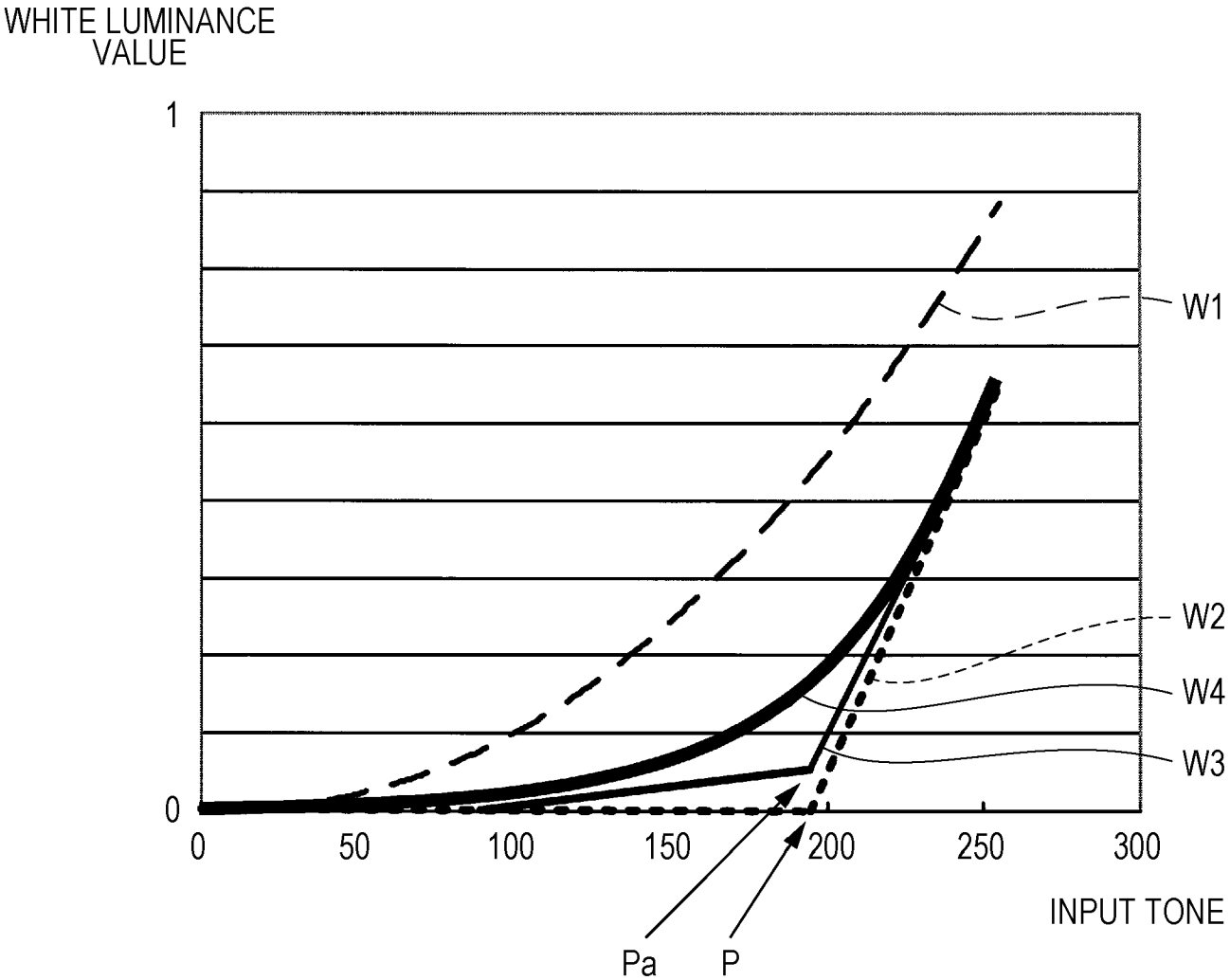
FIG. 7 illustrates variations in white luminance of W sub-pixels.

Next, control for white luminance will be described in detail below. FIG. 7 illustrates variations in white luminance of W sub-pixels. Specifically, the variations in the white luminance of the W sub-pixels in a gray scale are illustrated, the vertical axis represents a white luminance value generated by each W sub-pixel, and the horizontal axis represents an input tone.

A curve W1 (dashed line in FIG. 7) represents a variation of a white luminance value of a W sub-pixel in a high-definition liquid crystal panel before a problem (the problem that the outline of the arrangement of the W sub-pixel is visually recognized) is solved in the related art (Japanese Unexamined Patent Application Publication No. 2010-33009). Hereinafter, a generation mode of white luminance like the curve W1 is called a normal mode.

A curve W2 (dotted line in FIG. 7) represents a variation of a white luminance value of a W sub-pixel in the related art. Hereinafter, a generation mode of white luminance like the curve W2 is called a V2-1 mode (in which an averaging process is not performed).

A curve W3 (thin solid line in FIG. 7) represents a variation of a white luminance value of a W sub-pixel obtained by adjusting a ratio between the white luminance value of the curve W1 and the white luminance value of the curve W2 in a ratio of 1:7 (averaging process) in the related art. Hereinafter, a generation mode of white luminance like the curve W3 is called a V2-2 mode (in which an averaging process is performed).

A curve W4 (thick solid line in FIG. 7) is an ideal curve of a white luminance value of a W sub-pixel and represents a generation amount of white luminance of the W sub-pixel for the input tone, which is obtained in the image processing apparatus 1-1. Hereinafter, a generation mode of white luminance like the curve W4 is called an embodiment mode. Each of the operation modes will be described below.

Normal Mode

Figure 8:
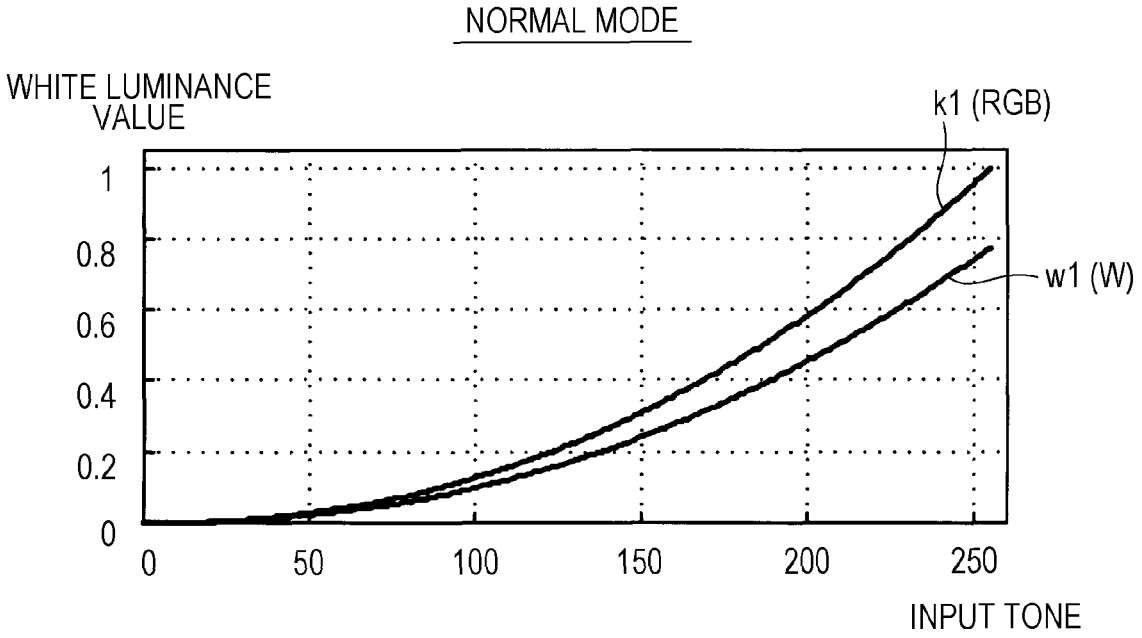
FIG. 8 illustrates variations in white luminance of RGB sub-pixels and a W sub-pixel.

FIG. 8 illustrates variations in white luminance of RGB sub-pixels and a W sub-pixel. Specifically, the variations in the white luminance of both the RGB sub-pixels and the W sub-pixel in a gray scale in the normal mode are illustrated, the vertical axis represents a white luminance value, and the horizontal axis represents an input tone.

In FIG. 8, a curve w1 represents the variation in the white luminance generated by the W sub-pixel and a curve k1 represents the variation in the white luminance generated by the RGB sub-pixels.

As indicated by the curve W1 in FIG. 7 and the curve w1 in FIG. 8, in the normal mode, as the input tone increases to shift from black to gray to white, the white luminance of the W sub-pixel increases in stages.

The W sub-pixel is used over all input tones and there is no significant difference in a ratio between the white luminance generated by the RGB sub-pixels and the white luminance generated by the W sub-pixel in proportion to the increase in the input tone. For this reason, the white luminance of the W sub-pixel is too intense and the outline of the arrangement of the W sub-pixel may be visually recognized on a screen.

V2-1 Mode

Figure 9:
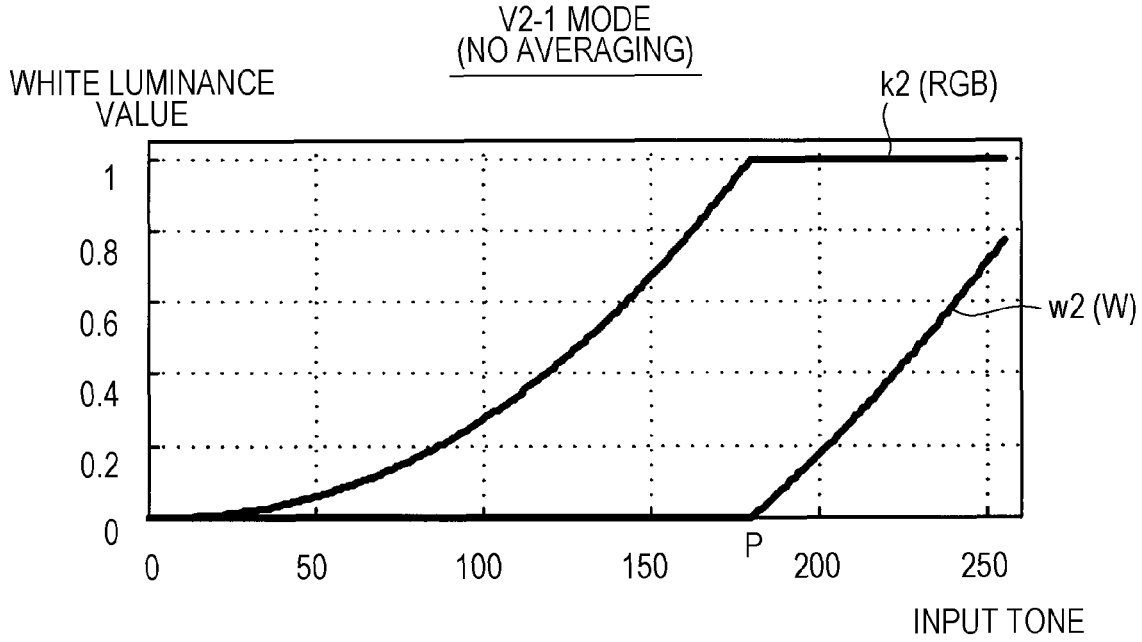
FIG. 9 illustrates variations in white luminance of RGB sub-pixels and a W sub-pixel.

FIG. 9 illustrates variations in white luminance of RGB sub-pixels and a W sub-pixel. Specifically, the variations in the white luminance of both the RGB sub-pixels and the W sub-pixel in a gray scale in the V2-1 mode are illustrated, the vertical axis represents a white luminance value, and the horizontal axis represents an input tone.

In FIG. 9, a curve w2 represents the variation in the white luminance generated by the W sub-pixel and a curve k2 represents the variation in the white luminance generated by the RGB sub-pixels.

As indicated by the curve W2 in FIG. 7 and the curve w2 in FIG. 9, in the V2-1 mode, the white luminance value of the W sub-pixel is 0 up to an input tone of a predetermined value P and increases in a linear manner beyond the predetermined value P.

As illustrated in the curve k2 in FIG. 9, in the V2-1 mode, the white luminance value of the RGB sub-pixels increases up to the predetermined value P to form a rising curve and an amount of increase in the white luminance value is constant beyond the predetermined value P.

In the V2-1 mode, the W sub-pixel is not used up to an input tone of the predetermined value P and white luminance is generated by the RGB sub-pixels. The W sub-pixel is also used at input tones above the predetermined value P and the white luminance generated by the W sub-pixel is added.

In this way, the W sub-pixel is used from a certain level of high input tone and the white luminance thereof is added, thereby causing the outline of the arrangement of the W sub-pixel that is visually recognized in the normal mode to disappear from a screen.

However, when white luminance is adjusted in the V2-1 mode, a color change between white color generated by the RGB sub-pixels and white color generated by the W sub-pixel may be visually recognized on the screen as a boundary.

At tones below the predetermined value P, the white luminance is generated by only the RGB sub-pixels. At tones of the predetermined value P or greater, the white luminance generated by the W sub-pixel is added to the white luminance generated by the RGB sub-pixels. Hence, the predetermined value P is a discontinuous point at which a color change significantly occurs on the curve W2.

There is a difference in chromaticity between white color generated by a W sub-pixel and white color generated by RGB sub-pixels, and therefore, especially, at a discontinuous point like the predetermined value P, a color change between the white color generated by the RGB sub-pixels and the white color generated by the W sub-pixel may be visually recognized on a screen.

V2-2 Mode

Figure 10:
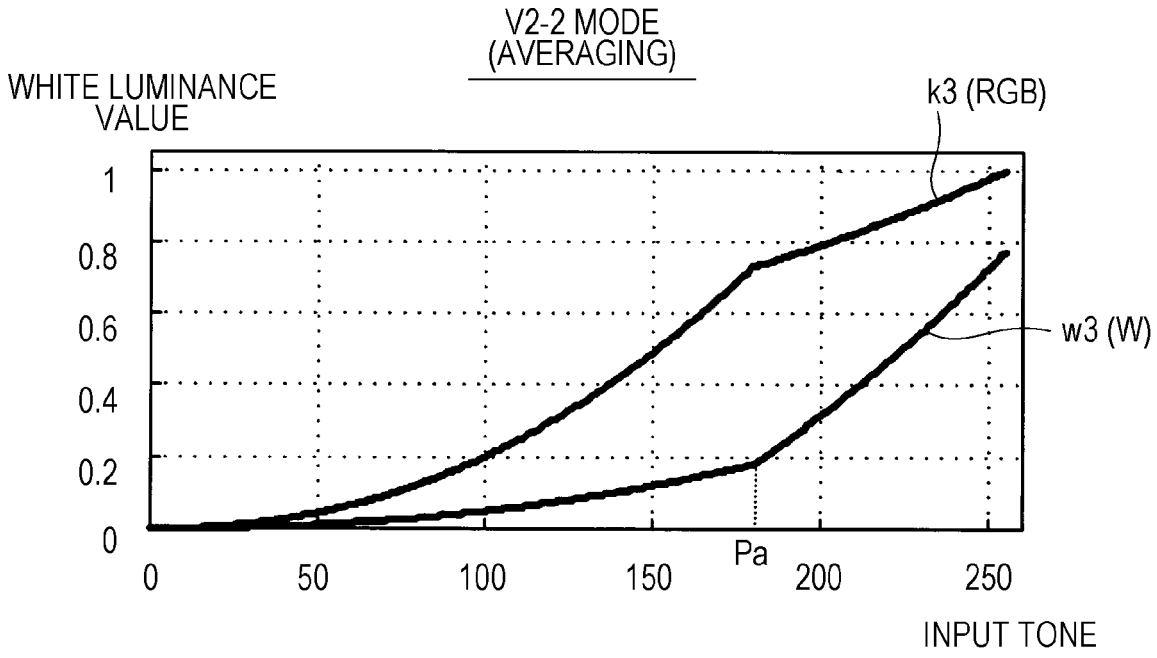
FIG. 10 illustrates variations in white luminance of RGB sub-pixels and a W sub-pixel.

FIG. 10 illustrates variations in white luminance of RGB sub-pixels and a W sub-pixel. Specifically, the variations in the white luminance of both the RGB sub-pixels and the W sub-pixel in a gray scale in the V2-2 mode are illustrated, the vertical axis represents a white luminance value, and the horizontal axis represents an input tone.

In FIG. 10, a curve w3 represents the variation in the white luminance generated by the W sub-pixel and a curve k3 represents the variation in the white luminance generated by the RGB sub-pixels.

As indicated by the curve W3 in FIG. 7 and the curve w3 in FIG. 10, in the V2-2 mode, over all input tones, the proportion of the white luminance value generated by the W sub-pixel is sufficiently smaller than that of the white luminance value generated by the RGB sub-pixels. Hence, the outline of the arrangement of the W sub-pixel is not visually recognized on a screen.

However, even when an averaging process is performed as in the V2-2 mode, RGB sub-pixels and a W sub-pixel have a discontinuous point of a color change (referred to as a discontinuous point Pa) as in the V2-1 mode. At the discontinuous point Pa, a color change between white color generated by the RGB sub-pixels and white color generated by the W sub-pixel appears on a screen.

Embodiment Mode

Figure 11:
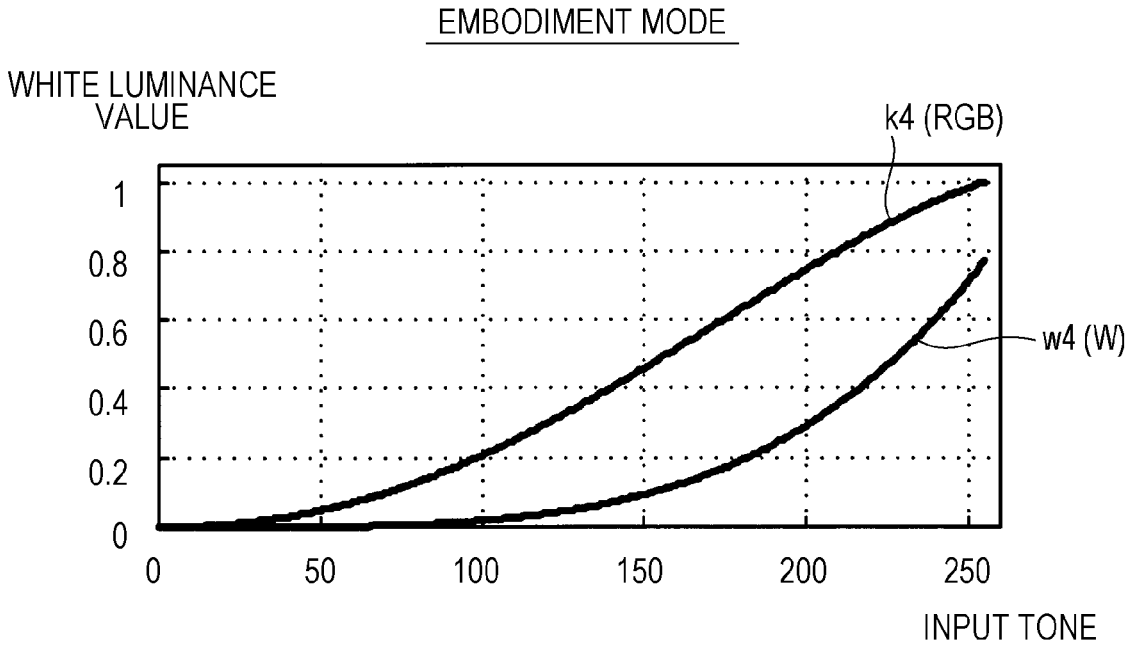
FIG. 11 illustrates variations in white luminance of RGB sub-pixels and a W sub-pixel.

FIG. 11 illustrates variations in white luminance of RGB sub-pixels and a W sub-pixel. Specifically, the variations in the white luminance of both the RGB sub-pixels and the W sub-pixel in a gray scale in the embodiment mode are illustrated, the vertical axis represents a white luminance value, and the horizontal axis represents an input tone.

In FIG. 11, a curve w4 represents the variation in the white luminance generated by the W sub-pixel and a curve k4 represents the variation in the white luminance generated by the RGB sub-pixels.

As indicated by the curve W4 in FIG. 7 and the curve w4 in FIG. 11, in the embodiment mode, the proportion of the white luminance value generated by the W sub-pixel is smaller than that of the curve W1 as a whole (the proportion of the white luminance value generated by the W sub-pixel is sufficiently small, especially, at tones in the vicinity of 150 or less). Hence, the outline of the arrangement of the W sub-pixel is not visually recognized on a screen.

The curves W4 and w4 in the embodiment mode are continuous over all input tones, do not each have a discontinuous point as is seen in the V2-1 and V2-2 modes, and each form a smooth curve. The fact that there are no discontinuous points means that there are no points at which white luminance significantly changes at any of the tones and that the change in white luminance is smooth.

Similarly, the curve k4 of the RGB sub-pixels in FIG. 11 is continuous over all the input tones, does not have a discontinuous point as is seen in the V2-1 and V2-2 modes, and forms a smooth curve. The fact that there are no discontinuous points means that there are no points at which white luminance significantly changes at any of the tones and that the change in white luminance is smooth.

Hence, in the embodiment mode, because a color change between the white luminance generated by the RGB sub-pixels and the white luminance generated by the W sub-pixel is smooth (gradation smooth) over all the input tones, there is no boundary of the color change and the color change is not visually recognized on a screen. The image processing apparatus 1-1 controls white luminance of a W sub-pixel so as to satisfy the shapes of the curves W4 and w4.

In FIGS. 9 and 10, the cases where the functions (curves k2 and k3) each representing the change of the white luminance value of the RGB sub-pixels each have a discontinuous point are illustrated as examples. However, even if a function representing a change of a white luminance value of RGB sub-pixels has no discontinuous points and only a function representing a change of a white luminance value of a W sub-pixel has a discontinuous point, a color change may be visually recognized on a screen.

Figure 12:
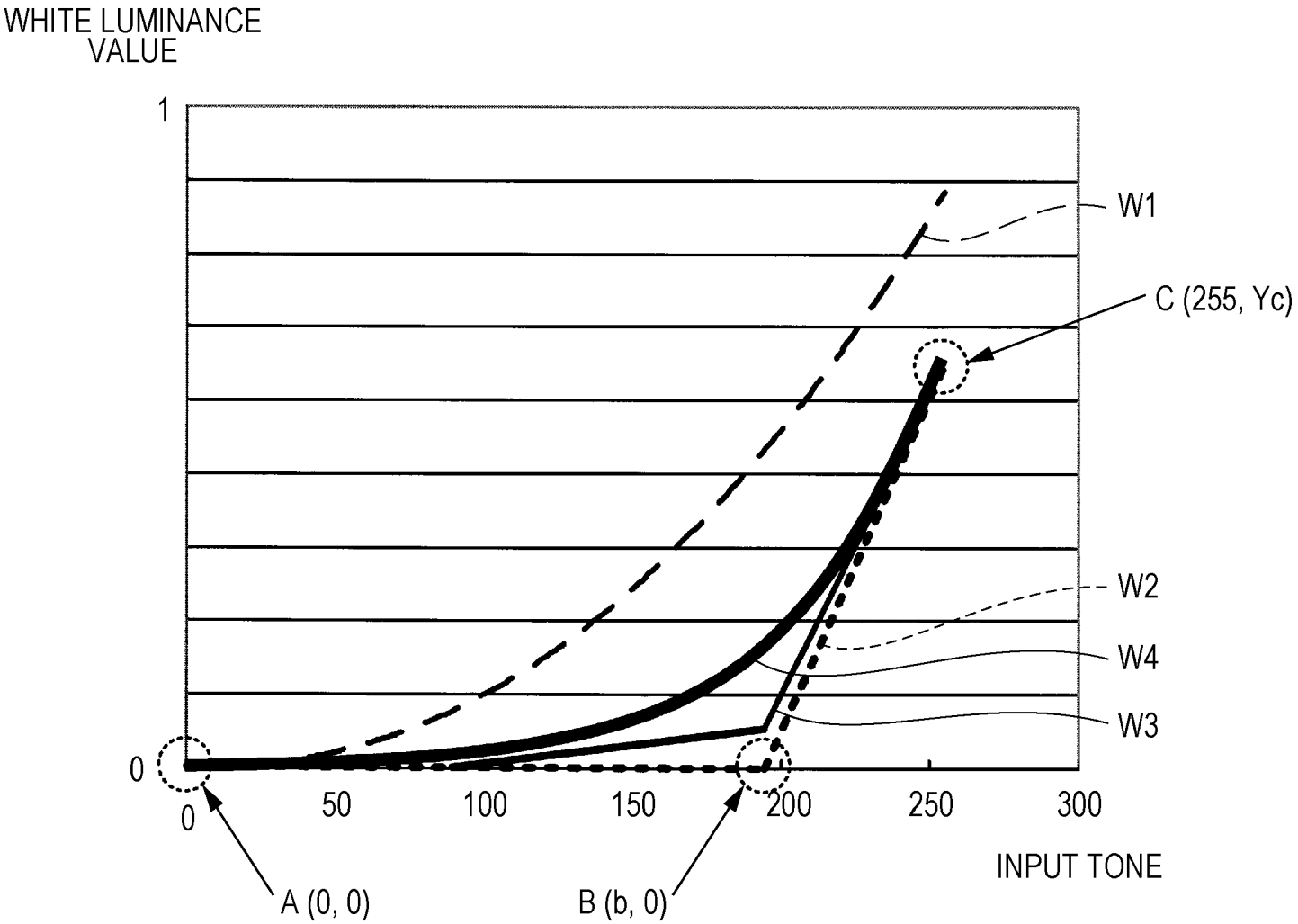
FIG. 12 illustrates variations in white luminance of W sub-pixels.

Next, a function of the ideal curve W4 illustrated in FIG. 7 will be described. FIG. 12 illustrates variations in white luminance of W sub-pixels. Specifically, the variations in the white luminance in a gray scale are illustrated, the vertical axis represents a white luminance value generated by each W sub-pixel, and the horizontal axis represents an input tone.

A spline interpolation is performed on a curve W2 so as to create a curve W4. A spline interpolation is an algorithm for defining a curve from multiple given control points. A curve obtained by performing a spline interpolation is called a spline curve.

Here, the case of obtaining the curve W4 when the image processing apparatus 1-1 has an ability to represent an image with an n-bit tone will be discussed. Three control points are denoted as A (Ax, Ay), B (Bx, By), and C (Cx, Cy). Basis (B)-spline curve interpolation formulas for this case are defined by the following formulas (1a), (1b), and (1c).

$$X=(1-t)^{2\times Ax}+2t(1-t)\times Bx+t^{2\times Cx} \quad (1a)$$

$$Y=(1-t)^{2\times Ay}+2t(1-t)\times By+t^{2\times Cy} \quad (1b)$$

$$t=\lambda/(2^n-1) \quad (1c)$$

The formula (1a) represents an X coordinate value and the formula (1b) represents a Y coordinate value. $\lambda$ in the formula (1c) is a value of an input tone. Here, if an 8-bit tone representation is adopted, n=8 and therefore $t=\lambda/255$ in the formula (1c). At this time, $\lambda$ is taken from discrete values ranging from 0 to 255 and therefore $0\leq t\leq 1$.

Here, control points selected on the curve W2 are denoted as a point A, a point B, and a point C, as illustrated in FIG. 12. The respective coordinate values are A (Ax, Ay)=(0, 0), B (Bx, By)=(b, 0), and C (Cx, Cy)=(255, Yc). Yc is a value less than or equal to a maximum value of white luminance generated by a W sub-pixel. The control points are determined from empirical values or observed values.

Substituting the above-described A (0, 0), B (b, 0), and C (255, Yc) into the formulas (1a) and (1b) gives the following formulas (2a) and (2b).

$$X=1+2t(1-t)\times b+t^{510}=2bt(1-t)+1+t^{510} \quad (2a)$$

$$Y=1+0+t^{2\times Yc}=1+t^{2\times Yc} \quad (2b)$$

The curve W4 is defined from the formulas (2a) and (2b) (eliminating a variable t from the two formulas gives an X-Y function, which represents the curve W4). In this way, the ideal curve W4 is successfully obtained from the B-spline curve interpolation formulas defined by formulas (1a), (1b), and (1c).

In the above description, the curve W4 is calculated from a spline interpolation. However, because the curve W4 can be seen as an exponential function, a relationship between a white luminance value and an input tone can be represented using an exponential function. In this case, for example, the curve W4 is represented by the following formula (3), where Y is a white luminance value and X is an input tone. Because the shape of the curve of the formula (3) is almost the same as the curve W4, illustration thereof is omitted.

$$Y=Yc\times t^4=Yc\times(X/(2^n-1))^4 \quad (3)$$

As described above, the image processing apparatus of the present application makes a generation amount of white luminance generated by a W sub-pixel lower than a generation amount of white luminance generated by RGB sub-pixels over all input tones and makes a function of the white luminance generated by the W sub-pixel a continuous function over all the input tones.

Hence, the outline of the arrangement of the W sub-pixel is not visually recognized on a screen. In addition, degradation of image quality due to a color change resulting from a difference between the white luminance generated by the W sub-pixel and the white luminance generated by the RGB sub-pixels may be improved, thereby improving the image quality.

The present application may have the following structures.

(1) An image processing apparatus including:

an image display unit that includes pixels arranged in a matrix, each of which is formed of a first sub-pixel, a second sub-pixel, a third sub-pixel, and a fourth sub-pixel, and that performs image display; and a luminance control unit that adjusts a ratio between a generation amount of first luminance generated by the first sub-pixel, the second sub-pixel, and the third sub-pixel and a generation amount of second luminance generated by the fourth sub-pixel, wherein, over all input tones, the luminance control unit makes the generation amount of the second luminance lower than the generation amount of the first luminance and generates the second luminance so that a function representing a luminance value of the second luminance is continuous.

(2) The image processing apparatus according to item (1), wherein the first sub-pixel is a red sub-pixel, the second sub-pixel is a green sub-pixel, the third sub-pixel is a blue sub-pixel, and the fourth sub-pixel is a white sub-pixel, and wherein the luminance control unit adjusts a ratio between a generation amount of first white luminance generated by the red sub-pixel, the green sub-pixel, and the blue sub-pixel and a generation amount of second white luminance generated by the white sub-pixel, and over all input tones, makes the generation amount of the second white luminance lower than the generation amount of the first white luminance and generates the second white luminance so that a function representing a luminance value of the second white luminance is continuous.

(3) The image processing apparatus according to item (1) or (2), wherein, when an ability to represent an image with an n-bit tone is given, the luminance control unit calculates the function representing a luminance value of the second white luminance by performing a spline interpolation using formulas defined by $$X=(1-t)^{2\times Ax}+2t(1-t)\times Bx+t^{2\times Cx},$$

$$Y=(1-t)^{2\times Ay}+2t(1-t)\times By+t^{2\times Cy}, \text{ and}$$

$$t=\lambda/(2^n-1),$$

where (Ax, Ay), (Bx, By), and (Cx, Cy) are control points and t is an input tone.

(4) The image processing apparatus according to item (3), wherein the luminance control unit determines, as the function representing a luminance value of the second white luminance, a spline curve obtained by performing the spline interpolation on three points of (0, 0), (b, 0), and (255, Yc), where Yc is a value less than or equal to a maximum value of the second white luminance generated by the white sub-pixel and b is a value of an input tone.

(5) The image processing apparatus according to item (1) or (2), wherein, when an ability to represent an image with an n-bit tone is given, the luminance control unit determines, as the function representing a luminance value of the second white luminance, an exponential function defined by $$Y=Yc\times(X/(2^n-1))^4,$$

where Yc is a value less than or equal to a maximum value of the second white luminance generated by the white sub-pixel, X is an input tone, and Y is a value of the second white luminance.

(6) An image processing method including:

performing image display with pixels arranged in a matrix, each of which is formed of a first sub-pixel, a second sub-pixel, a third sub-pixel, and a fourth sub-pixel;

adjusting a ratio between a generation amount of first luminance generated by the first sub-pixel, the second sub-pixel, and the third sub-pixel and a generation amount of second luminance generated by the fourth sub-pixel; and over all input tones, making the generation amount of the second luminance lower than the generation amount of the first luminance and generating the second luminance so that a function representing a luminance value of the second luminance is continuous.

(7) The image processing method according to item (6), wherein the first sub-pixel is a red sub-pixel, the second sub-pixel is a green sub-pixel, the third sub-pixel is a blue sub-pixel, and the fourth sub-pixel is a white sub-pixel, wherein a ratio between a generation amount of first white luminance generated by the red sub-pixel, the green sub-pixel, and the blue sub-pixel and a generation amount of second white luminance generated by the white sub-pixel is adjusted, and wherein, over all input tones, the generation amount of the second white luminance is made lower than the generation amount of the first white luminance and the second white luminance is generated so that a function representing a luminance value of the second white luminance is continuous.

(8) The image processing method according to item (6) or (7), wherein, when an ability to represent an image with an n-bit tone is given, the function representing a luminance value of the second white luminance is calculated by performing a spline interpolation using formulas defined by $$X=(1-t)^{2\times Ax}+2t(1-t)\times Bx+t^{2\times Cx},$$

$$Y=(1-t)^{2\times Ay}+2t(1-t)\times By+t^{2\times Cy}, \text{ and}$$

$$t=\lambda/(2^n-1),$$

where (Ax, Ay), (Bx, By), and (Cx, Cy) are control points and t is an input tone.

(9) The image processing method according to item (8), wherein a spline curve obtained by performing the spline interpolation on three points of (0, 0), (b, 0), and (255, Yc), where Yc is a value less than or equal to a maximum value of the second white luminance generated by the white sub-pixel and b is a value of an input tone, is determined as the function representing a luminance value of the second white luminance.

(10) The image processing method according to item (6) or (7), wherein, when an ability to represent an image with an n-bit tone is given, an exponential function defined by $$Y=Yc\times(X/(2^n-1))^4,$$

where Yc is a value less than or equal to a maximum value of the second white luminance generated by the white sub-pixel, X is an input tone, and Y is a value of the second white luminance, is determined as the function representing a luminance value of the second white luminance.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image processing apparatus comprising:

an image display unit that includes pixels arranged in a matrix, each of which is formed of a first sub-pixel, a second sub-pixel, a third sub-pixel, and a fourth sub-pixel, and that performs image display; and a luminance control unit that adjusts a ratio between a generation amount of first luminance generated by the first sub-pixel, the second sub-pixel, and the third sub-pixel and a generation amount of second luminance generated by the fourth sub-pixel, wherein, over all input tones, the luminance control unit makes the generation amount of the second luminance lower than the generation amount of the first luminance and generates the second luminance so that a function representing a luminance value of the second luminance is continuous, wherein the first sub-pixel is a red sub-pixel, the second sub-pixel is a green sub-pixel, the third sub-pixel is a blue sub-pixel, and the fourth sub-pixel is a white sub-pixel, and wherein the luminance control unit adjusts a ratio between a generation amount of first white luminance generated by the red sub-pixel, the green sub-pixel, and the blue sub-pixel and a generation amount of second white luminance generated by the white sub-pixel, and over all input tones, makes the generation amount of the second white luminance lower than the generation amount of the first white luminance and generates the second white luminance so that a function representing a luminance value of the second white luminance is continuous, wherein, when an ability to represent an image with an n-bit tone is given, the luminance control unit calculates the function representing a luminance value of the second white luminance by performing a spline interpolation using formulas defined by $$X=(1-t)^{2\times Ax}+2t(1-t)\times Bx+t^{2\times Cx},$$

$$Y=(1-t)^{2\times Ay}+2t(1-t)\times By+t^{2\times Cy}, \text{ and}$$

$$t=\lambda/(2^n-1),$$

where X is a X coordinate value, Y is a Y coordinate value, t is an input tone, (Ax, Ay), (Bx, By), and (Cx, Cy) are control points, and λ is a value of an input tone.

2. The image processing apparatus according to claim 1, wherein the luminance control unit determines, as the function representing a luminance value of the second white luminance, a spline curve obtained by performing the spline interpolation on three points of (0, 0), (b, 0), and (255, Yc), where Yc is a value less than or equal to a maximum value of the second white luminance generated by the white sub-pixel and b is a value of an input tone.

3. The image processing apparatus according to claim 1, wherein, when an ability to represent an image with an n-bit tone is given, the luminance control unit determines, as the function representing a luminance value of the second white luminance, an exponential function defined by $$Y=Yc\times(X/(2^n-1))^4,$$

where Yc is a value less than or equal to a maximum value of the second white luminance generated by the white sub-pixel, X is an input tone, and Y is a value of the second white luminance.

4. An image processing method comprising:

performing image display with pixels arranged in a matrix, each of which is formed of a first sub-pixel, a second sub-pixel, a third sub-pixel, and a fourth sub-pixel;

adjusting a ratio between a generation amount of first luminance generated by the first sub-pixel, the second sub-pixel, and the third sub-pixel and a generation amount of second luminance generated by the fourth sub-pixel; and over all input tones, making the generation amount of the second luminance lower than the generation amount of the first luminance and generating the second luminance so that a function representing a luminance value of the second luminance is continuous, wherein the first sub-pixel is a red sub-pixel, the second sub-pixel is a green sub-pixel, the third sub-pixel is a blue sub-pixel, and the fourth sub-pixel is a white sub-pixel, wherein a ratio between a generation amount of first white luminance generated by the red sub-pixel, the green sub-pixel, and the blue sub-pixel and a generation amount of second white luminance generated by the white sub-pixel is adjusted, and wherein, over all input tones, the generation amount of the second white luminance is made lower than the generation amount of the first white luminance and the second white luminance is generated so that a function representing a luminance value of the second white luminance is continuous, wherein, when an ability to represent an image with an n-bit tone is given, the function representing a luminance value of the second white luminance is calculated by performing a spline interpolation using formulas defined by $$X=(1-t)^{2\times Ax}+2t(1-t)\times Bx+t^{2\times Cx},$$

$$Y=(1-t)^{2\times Ay}+2t(1-t)\times By+t^{2\times Cy}, \text{ and}$$

$$t=\lambda/(2^n-1),$$

where X is a X coordinate value, Y is a Y coordinate value, t is an input tone, (Ax, Ay), (Bx, By), and (Cx, Cy) are control points, and λ is a value of an input tone.

5. The image processing method according to claim 4, wherein a spline curve obtained by performing the spline interpolation on three points of (0, 0), (b, 0), and (255, Yc), where Yc is a value less than or equal to a maximum value of the second white luminance generated by the white sub-pixel and b is a value of an input tone, is determined as the function representing a luminance value of the second white luminance.

6. The image processing method according to claim 4, wherein, when an ability to represent an image with an n-bit tone is given, an exponential function defined by $$Y=Yc\times(X/(2^n-1))^4,$$

where Yc is a value less than or equal to a maximum value of the second white luminance generated by the white sub-pixel, X is an input tone, and Y is a value of the second white luminance, is determined as the function representing a luminance value of the second white luminance.

* * * * *